US007543342B2

(12) United States Patent
Zhao et al.

(10) Patent No.: US 7,543,342 B2
(45) Date of Patent: Jun. 9, 2009

(54) PLAYARD

(75) Inventors: Guang-Hui Zhao, Taipei (TW); Hong-Bin Xu, Taipei (TW)

(73) Assignee: Wonderland NurseyGoods Co., Ltd., Taipei (TW)

( * ) Notice: Subject to any disclaimer, the term of this patent is extended or adjusted under 35 U.S.C. 154(b) by 0 days.

(21) Appl. No.: 12/196,293

(22) Filed: Aug. 22, 2008

(65) Prior Publication Data

US 2009/0049605 A1 Feb. 26, 2009

Related U.S. Application Data

(60) Provisional application No. 60/957,171, filed on Aug. 22, 2007.

(51) Int. Cl.
*A47D 7/04* (2006.01)
*A47D 13/06* (2006.01)

(52) U.S. Cl. ..... 5/93.1; 5/98.1; 5/655

(58) Field of Classification Search ..... 5/93.1, 5/93.2, 95, 98.1, 99.1, 655, 11
See application file for complete search history.

(56) References Cited

U.S. PATENT DOCUMENTS 3,078,478 A * 2/1963 Sheahan ..... 5/93.1
6,192,535 B1 * 2/2001 Warner et al. ..... 5/93.1
6,233,759 B1 * 5/2001 Warner et al. ..... 5/99.1
6,550,082 B2 * 4/2003 Tharalson et al. ..... 5/95
6,735,796 B2 * 5/2004 Warner et al. ..... 5/99.1
2001/0001161 A1 * 5/2001 Warner et al. ..... 5/99.1
2001/0001162 A1 * 5/2001 Warner et al. ..... 5/99.1
2001/0001330 A1 * 5/2001 Warner et al. ..... 5/99.1
2002/0083524 A1 * 7/2002 Tharalson et al. ..... 5/95
2005/0150053 A1 * 7/2005 Hartenstine ..... 5/655
2007/0061961 A1 * 3/2007 Shamie ..... 5/93.1
2007/0204403 A1 * 9/2007 Hartenstine ..... 5/655
2007/0204404 A1 * 9/2007 Hartenstine ..... 5/655
2009/0049605 A1 * 2/2009 Zhao et al. ..... 5/93.1
2009/0056013 A1 * 3/2009 Hartenstine et al. ..... 5/93.1

* cited by examiner

*Primary Examiner*—Robert G Santos
(74) *Attorney, Agent, or Firm*—Winston Hsu

(57) ABSTRACT

In a playard, the bassinet has adjustors with one ends connecting to a first side of the bassinet body and the other ends to a second side of the bassinet body. The adjustors extend from the first side toward and cross a first side rail of the frame body, reaching to the bottom panel of the frame body and into the frame body, and connecting to the second side of the bassinet body. The playard includes two retainers, each mounting on the second side rail of the frame body. Pulling the adjustors brings the first side and the second side of the bassinet body to move up or down by the same distance. The bassinet can therefore maintain horizontal and be adjusted to an arbitrary height during height adjusting.

10 Claims, 5 Drawing Sheets

PLAYARD

CROSS REFERENCE TO RELATED APPLICATIONS

This application claims the benefit of U.S. Provisional Application No. 60/957,171, which was filed on Aug. 22, 2007, and is incorporated herein by reference.

BACKGROUND OF THE INVENTION

1. Field of the Invention

The present invention relates to a playard, and more specifically, to a playard using a height adjustment device to adjust the height of a bassinet therein in a horizontal way.

2. Description of the Prior Art

Conventional playards usually includes a frame body and a detachable bassinet hanging on the frame body that provides lying place for a baby so that a babysitter can take care of the baby with more convenience. The bassinet usually hangs on the four arm rails of the frame body via hook hangers, with constant but deeper depth. Although deeper depth for a bassinet provides higher security, bigger space or better sheltering for the baby lying inside, it also causes greater inconvenience for the babysitter-he/she must bend down excessively before he/she is able to reach and hold the baby.

There are also some bassinet designs that give the bassinet two-way depth (or height) adjustability by using zipper or other ways of coupling. When the bassinet is zipped up, it has shallower depth so that the babysitter can take care of the baby with more convenience. If the zipper is opened, the bassinet in turn has deeper depth so that bigger child can play inside or rest. Such design, however, provides only two depth alternatives, which means arbitrary depth adjustability is not attainable for such design. Furthermore, conventional bassinet can not maintain horizontal and steady during height adjusting and inevitably cause disturbance for the baby lying therein.

SUMMARY OF THE INVENTION

The present invention provides a playard. The playard comprises a frame body, two retainers, and a bassinet. The frame body comprises two first side panels, two second side panels, and one bottom panel connecting to the two first side panels and the two second side panels to form a containing room. The two first side panels have a first side rail and a second side rail respectively. The two retainers are mounted on the second side rail of the frame body. The bassinet is placed in the containing room of the frame body. The bassinet comprises a bassinet body and two adjustors. The bassinet body has a first side and a second side opposite to each other. Each of the two adjustors has a first end and a second end opposite to each other. The first end connects to the first side of the bassinet and the second end extends from the first side of the bassinet body toward and cross the first side rail, reaching to the bottom panel of the frame body and entering into the containing room of the frame body, and connecting to the second side of the bassinet body and coupling to the retainer. The adjustor is movable relative to the retainer such that the length of the adjustor locating inside the frame body is changed. When the length of the adjustor locating inside the frame body changes, the bassinet body changes its height relative to the frame body.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 2 is an illustration showing the bassinet of the playard located in a lower height relative to the frame body and has a mattress to put on.

DETAILED DESCRIPTION

Figure 1:
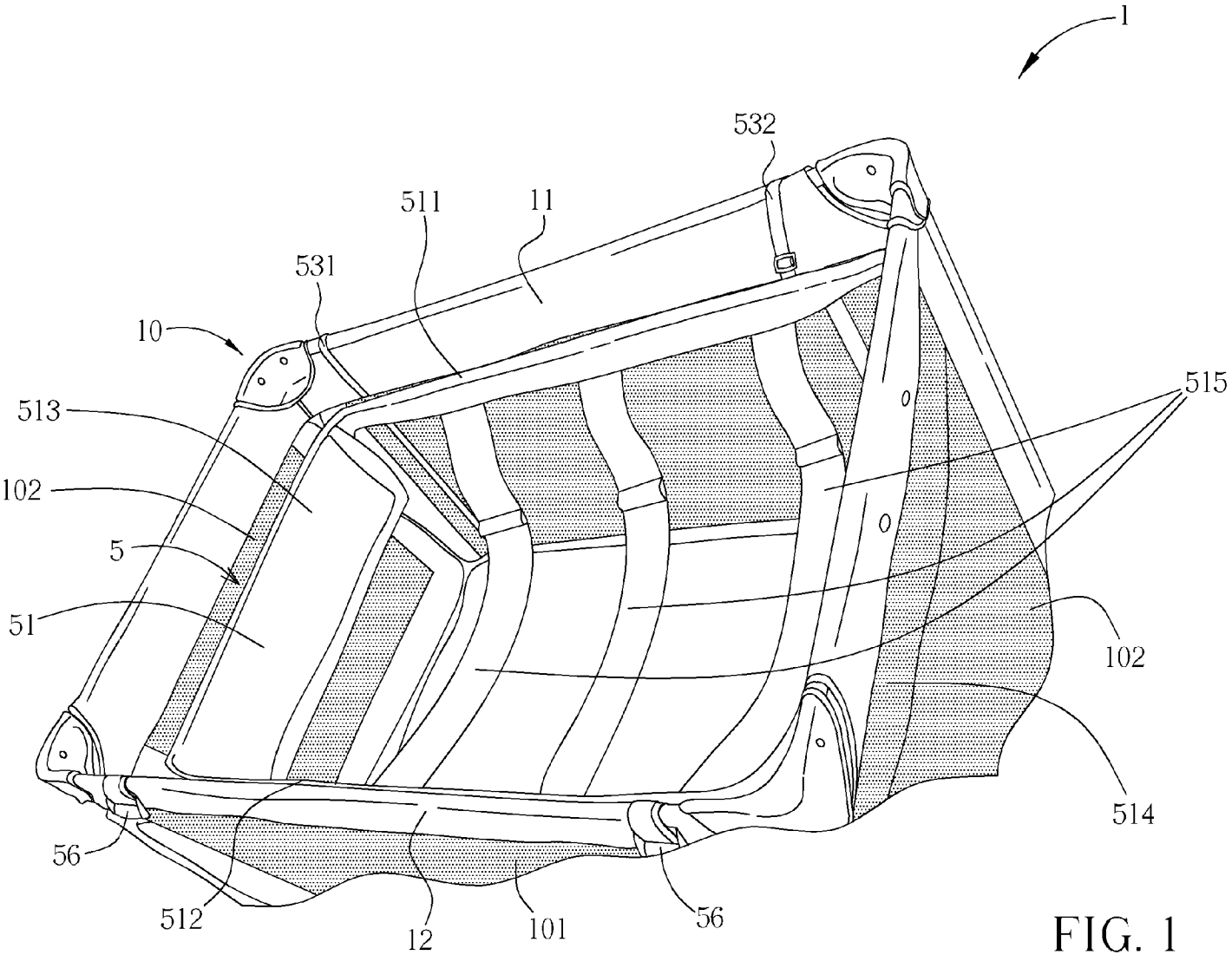
FIG. 1 is an illustration of a playard with a bassinet having height adjustability according to the present invention.
Figure 2:
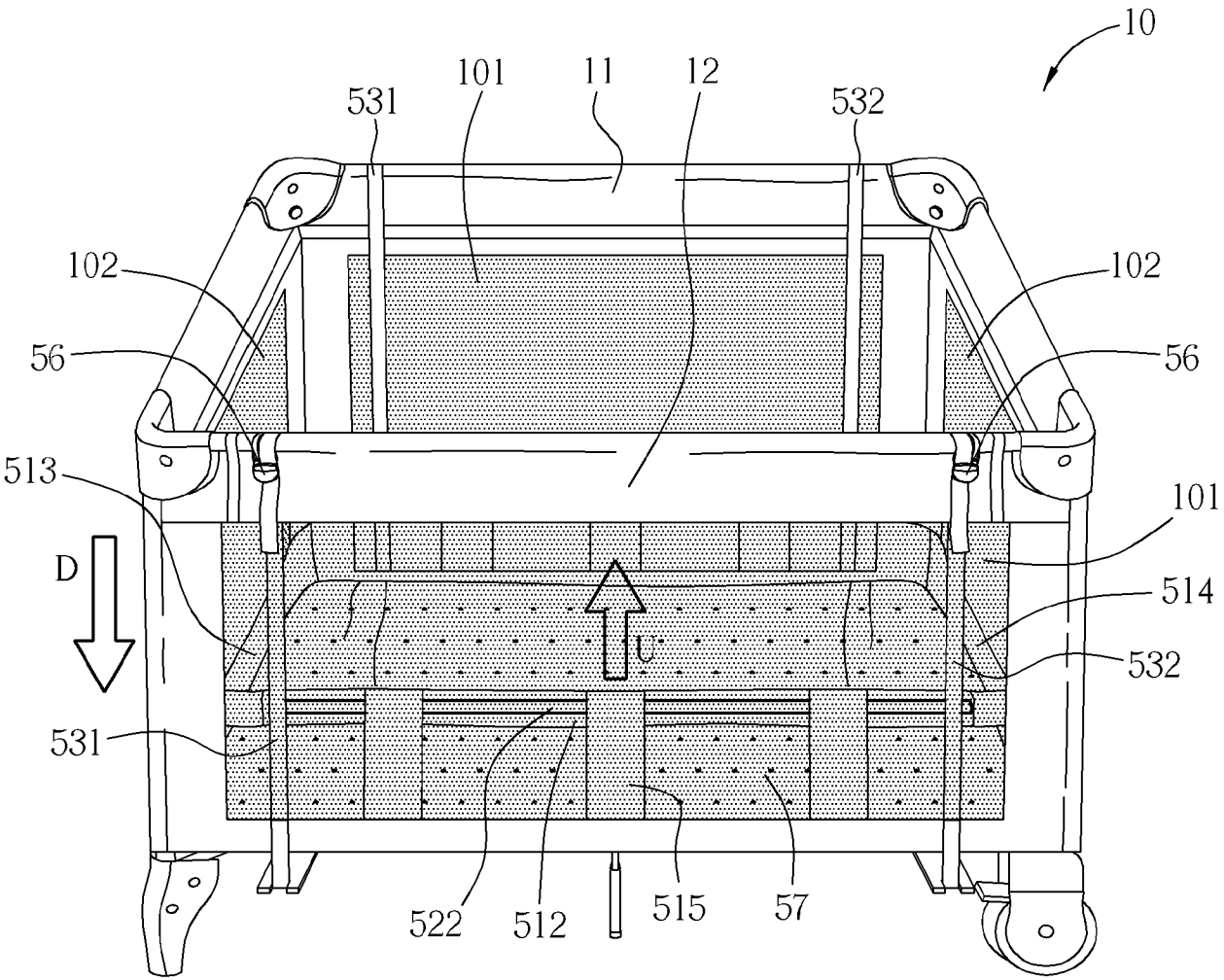

Please refer to FIG. 1 and FIG. 2. FIG. 1 is an illustration of a playard 1 with a bassinet 5 that has height adjustability. FIG. 2 is an illustration showing the bassinet 5 of the playard 1 placed on the bottom of the playard 1 and has a mattress 7 to be put on. The playard 1 includes a frame body 10, a bassinet 5 mounted within the frame body 10, and two retainers 56. The frame body 10, in this embodiment, includes two long first side panels 101 opposite to each other, two short second side panels 102 opposite to each other, and a bottom panel 13 that connects to the bottom ends of the first side panels 101 and the second side panels 102 and the panels 101,102,13 form a containing room for a baby or the bassinet 5. On top of the two opposite first side panels 101 are a first side rail 11 and a second side rail 12 respectively and the bassinet body 51 of the bassinet 5 is height adjustable relative to the frame body 10 via a height adjustment device. As FIG. 1 and FIG. 2 show, the bassinet 5 comprises a bassinet body 51, two positioners 522, two adjustors 531,532, and a mattress 57. The height adjustment device includes the positioners 522, the two adjustors 531,532, and two retainers 56. The bassinet body 51, in this embodiment, includes a first side 511 and a second side 512 opposite to each other that are correspondent to the first side rail 11 and the second side rail 12 of the frame body 10 respectively, and a third side 513 and a fourth side 514 that are correspondent to the second side panels 102 respectively. To shape the bassinet body 51, the bassinet body 51 has two positioners 522 mounted on the upper portion of the first side 511 and the second side 512 respectively. In this embodiment, there are plurality of strengtheners 515 connecting between the first side 511 and the second side 512. The positioners 522 may pass through ring structures formed at the ends of the strengtheners 515 and can be removed from the bassinet body 51. In this embodiment, the positioners 522 are metal pipes so that the soft and flexible bassinet body 51 can be supported by the positioners 522, while in other embodiments, the positioners 522 can fix on the bassinet body 51 by other forms. FIG. 1 shows that the bassinet 5 locates inside the frame body 10. The first ends of the adjustors 531,532 connect to the positioner 522, which in FIG. 1 is hidden behind the soft goods of the first side 511, at the first side 511 of the bassinet body 51. The second ends of the adjustors 531,532 extend from the first side 511 of the bassinet body 51 upward and cross outward the first side rail 11 of the frame body 10, reaching to the bottom panel 13 of the frame body 10, shown in FIG. 3, and pass through an opening A, shown in FIG. 5, locating at the second side rail 12 so as to enter into the containing room of the frame body 10, and finally connecting to the positioner 522 at the second side 512 of the bassinet body 51, shown in FIG. 2 and FIG. 4.

Figure 4:
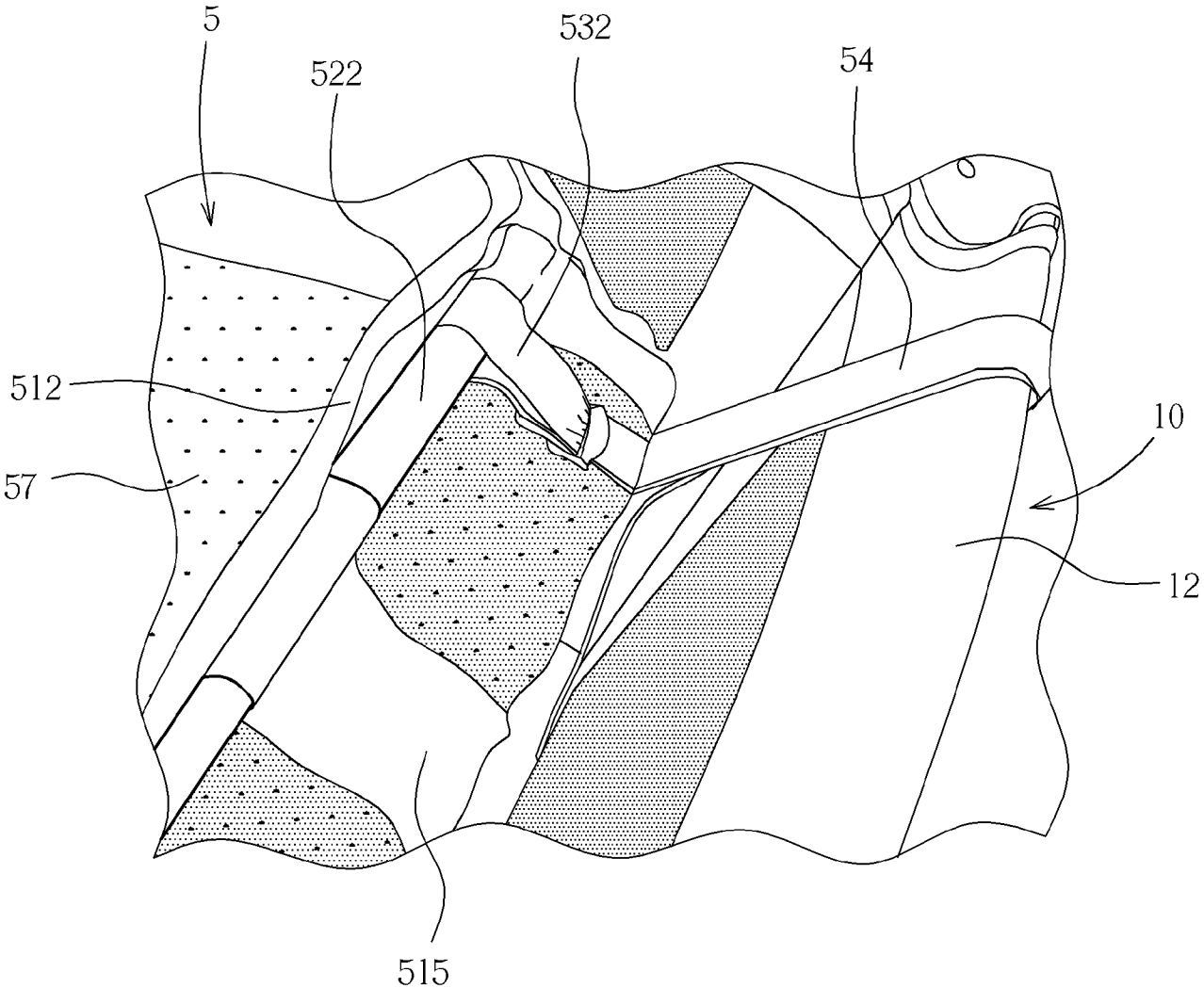
FIG. 4 is an illustration showing an adjustor of the bassinet connecting to a second side rail.
Figure 5:
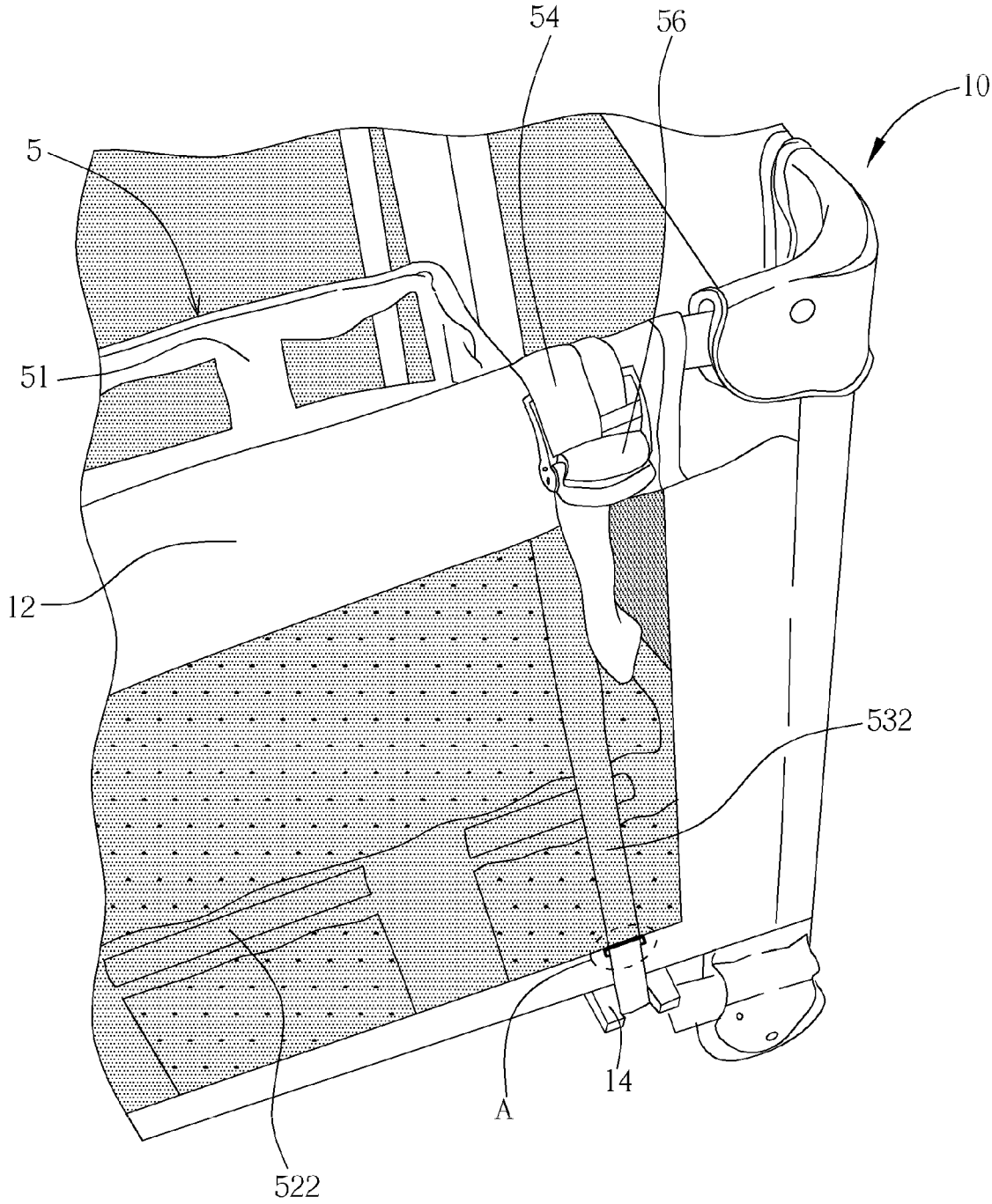
FIG. 5 is an illustration of the adjustor connecting to a retainer.

Please refer to FIG. 4 and FIG. 5. FIG. 4 is an illustration showing an adjustor 532 of the bassinet 5 connecting to the second side rail 12 of the frame body 10 and FIG. 5 is an illustration of the adjustor 532 connecting to the retainer 56 with an adjusting belt 54. The retainer 56 is mounted on the second side rail 12 of the frame body 10 and in this embodiment, the retainer 56 can be detachably mounted on the second side rail 12 via a hook or other coupling device. The adjusting belts 54 can further be used to connect to the second ends of the adjustors 531,532 with first ends, where the second ends of the adjustors 531,532 connect to the positioner 522 at the second side 512 of the bassinet body 51 as shown in FIG. 4, and second ends of the adjusting belts 54 pass through the retainers 56 that can fasten or release the adjusting belts 54. When the adjusting belts 54 move relative to the retainers 56, the length between the one ends of the adjusting belts 54 at the second ends of the adjustors 531,532 and the retainers 56 changes. Additionally, the adjustors 531,532 and the two adjusting belts 54 can be soft straps or other flexible soft goods. The retainers 56 in this embodiment is designed for allowing the adjusting belts 54 to move freely in only one direction and retaining the adjusting belts 54 in any position, and the retainers 56 must be released first before the adjusting belts 54 are able to move in opposite direction. In other embodiments, the adjusting belts 54 are movable relative to the retainers 56 only when the retainers 56 are released. The adjusting belts 54 can also be formed by the extension part of the adjustors 531,532. For example, after the adjustor 531, or the adjustor 532, forms a ring structure that connects the positioner 522 at the second side 512 of the bassinet body 5, the adjustors 531,532 extend upward and cross the second side rail 12 and connect to the correspondent retainer 56 respectively so that the structure is similar as the previous embodiment.

Figure 3:
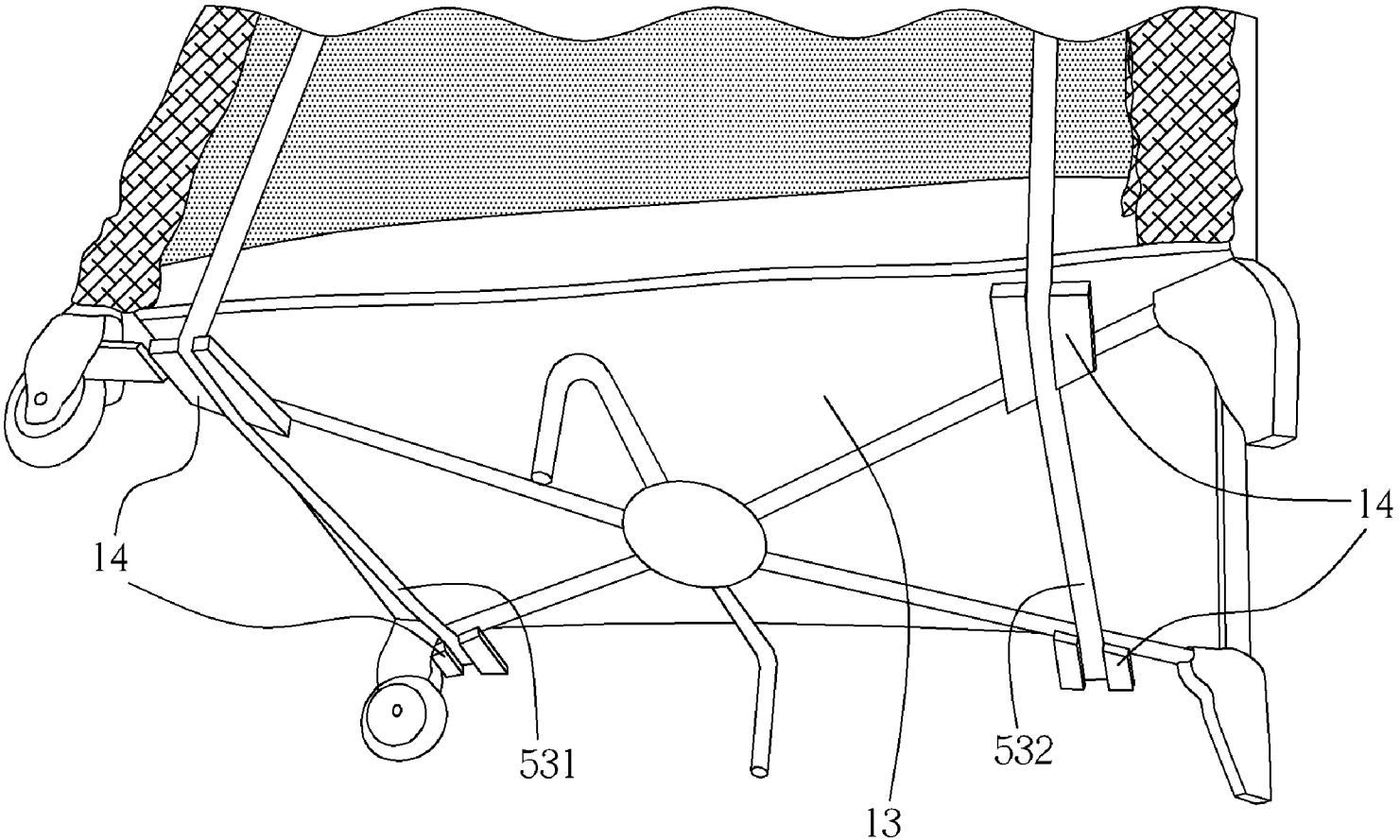
FIG. 3 is an illustration showing the bottom of the playard.

Please refer to FIG. 3, which is an illustration showing the bottom panel 13 of the playard 1. When the adjustors 531,532 extend from the first side rail 11 downward and cross the bottom panel 13 of the frame body 10, a plurality of supporters 14 mounted at the bottom panel 13, near the first side panels 101, and locating at the path the adjustors 531,532 cross, confines the adjustors 531,532 to move along a direction back and forth relative to the frame body 10 and separates the adjustors 531,532 from the bottom panel 13 of the frame body 10. The adjustors 531,532 are avoided to rub against the frame body 10 to be worn during moving.

The way how the adjustors 531,532 connecting to the bassinet body 51, passing through the frame body 10 and coupling to the retainers 56 maintains the bassinet body 51 in horizontal status during height adjusting. Please keep referring to FIG. 1 and FIG. 2. As FIG. 2 shows, when the bassinet body 51 needs to be adjusted higher toward direction U, or upward, to what is shown in FIG. 1 so as to easily hold the baby out of the bassinet 5, pulling the adjustors 531,532 toward direction D, or downward, shortens the section's length of the adjustors 531,532 locating inside the frame body 10, or in other words, the length of the adjustors 531,532 between the second side 512 of the bassinet body 51 and the retainer 56 is shortened. Since the adjustors 531,532 have constant overall length, the second ends of the adjustors 531, 532 moving toward direction U causes the first ends of the adjustors 531,532 at the first side 511 to move the same distance. This ensures that the first side 511 and the second side 512 of the bassinet body 51 move the same distance toward direction U and the bassinet body 51 is kept horizontal when pulling the adjustors 531,532.

On the other hand, it only needs to release the retainers 56 to adjust the bassinet 5 to a lower height as shown in FIG. 2. The bassinet body 51 moves toward direction D because of its own weight and the bassinet body 51 is kept horizontal during movement until it moves to a desired position relative to the frame body 10. Locking the retainers 56 will stop the descending of the bassinet body 51. In such way, the bassinet body 51 and the mattress 57 thereon can be kept horizontal during height adjusting and can be lifted or lowered to an arbitrary height by user's need. Additionally, the retainers 56 can perform locking or releasing the adjustors 531,532 with separate operations or simply with one-step actuation, i.e., pressing the retainers 56 to release the adjustors 531,532 and auto-locking the adjustors 531,532 when releasing the retainers 56.

The playard disclosed in the present invention has a height adjustment device for the bassinet. The bassinet has adjustors with one ends connecting to the first side of the bassinet body and the other ends to the second side of the bassinet body. The adjustors extend from the first side toward and cross the first side rail of the frame body, reaching to the bottom panel of the frame body and into the frame body, and connecting to the second side of the bassinet body. The playard includes two retainers, each mounting on the second side rail of the frame body. Pulling the adjustors brings the first side and the second side of the bassinet body to move up or down by the same distance. The bassinet can therefore be kept horizontal and be adjusted to an arbitrary height during height adjusting.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A playard, comprising:

a frame body comprising two first side panels, two second side panels, and one bottom panel connecting to the two first side panels and the two second side panels to form a containing room, the two first side panels having a first side rail and a second side rail on top of the two first side panels respectively;

two retainers mounted on the second side rail of the frame body; and a bassinet placed in the containing room of the frame body, the bassinet comprising:

a bassinet body having a first side and a second side opposite to each other; and two adjustors, each having a first end and a second end opposite to each other, the first ends connecting to the first side of the bassinet and the second ends extending from the first side of the bassinet body toward and crossing the first side rail, reaching to the bottom panel of the frame body and entering into the containing room of the frame body, and connecting to the second side of the bassinet body and coupling to the retainers, the adjustors movable relative to the retainers such that the length of the adjustors locating inside the frame body is changed;

wherein when the length of the adjustors locating inside the frame body changes, the bassinet body changes its height relative to the frame body.

2. The playard of claim 1, wherein the bassinet further comprises a first positioner and a second positioner, mounted to the first side and the second side of the bassinet body respectively, the first ends of the two adjustors connecting to the first positioner respectively and the second ends of the two adjustors connecting to the second positioner respectively.

3. The playard of claim 2, wherein the first positioner and the second positioner are tubes.

4. The playard of claim 2, wherein the bassinet body further comprises a plurality of strengtheners configured between the first side and the second side, and the first positioner and the second positioner are removably connected to the ends of the strengtheners.

5. The playard of claim 1, wherein when the length of the two adjustors inside the frame body is changed, the first side and the second side of the bassinet body will have the same height change relative to the first side rail and the second side rail of the frame body respectively.

6. The playard of claim 1, wherein the two adjustors each comprise an adjusting belt respectively, and the adjusting belts connect to the second ends of the adjustors with first ends and are connected to the retainers with second ends.

7. The playard of claim 6, wherein the two adjustors and the two adjusting belts are soft goods.

8. The playard of claim 1, wherein the frame body further comprises a plurality of supporters mounted at the bottom panel, each configured near the side panels where the two adjustors extend, for confining the two adjustors to move along a direction back and forth relative to the frame body and for separating the two adjustors from the bottom panel of the frame body.

9. The playard of claim 1, wherein the bassinet further comprises a mattress placed on the bottom of the bassinet body.

10. The playard of claim 1, wherein the two adjustors are straps.

* * * * *

UNITED STATES PATENT AND TRADEMARK OFFICE

CERTIFICATE OF CORRECTION

PATENT NO. : 7,543,342 B2
APPLICATION NO. : 12/196293
DATED : June 9, 2009
INVENTOR(S) : Guang-Hui Zhao and Hong-Bin Xu It is certified that error appears in the above-identified patent and that said Letters Patent is hereby corrected as shown below:

On the title page, item (73), correct the name of the assignee from "Wonderland NurseyGoods Co., Ltd." to "Wonderland NurseryGoods Co., Ltd."

Signed and Sealed this

Fourth Day of August, 2009

JOHN DOLL
*Acting Director of the United States Patent and Trademark Office*